US011787033B2

(12) United States Patent
Semitka

(10) Patent No.: US 11,787,033 B2
(45) Date of Patent: Oct. 17, 2023

(54) MULTIFUNCTIONAL RECIPROCATING UTILITY DEVICE

(71) Applicant: Nick Semitka, Antioch, IL (US)

(72) Inventor: Nick Semitka, Antioch, IL (US)

( * ) Notice: Subject to any disclaimer, the term of this patent is extended or adjusted under 35 U.S.C. 154(b) by 0 days.

(21) Appl. No.: 17/736,816

(22) Filed: May 4, 2022

(65) Prior Publication Data

US 2022/0355458 A1 Nov. 10, 2022

Related U.S. Application Data

(60) Provisional application No. 63/183,993, filed on May 4, 2021.

(51) Int. Cl.
*B25F 3/00* (2006.01)
*B25F 5/02* (2006.01)

(52) U.S. Cl.
CPC . *B25F 3/00* (2013.01); *B25F 5/02* (2013.01)

(58) Field of Classification Search
CPC ..... A01G 3/053; B25F 3/00
See application file for complete search history.

(56) References Cited

U.S. PATENT DOCUMENTS

| | | | | |
|---|---|---|---|---|
| 9,561,546 | B1 * | 2/2017 | Walter | B23B 39/00 |
| 2016/0227694 | A1 * | 8/2016 | Bermudez | A01D 42/00 |
| 2016/0375571 | A1 * | 12/2016 | Gieske | B27B 17/0008 30/296.1 |
| 2018/0133862 | A1 * | 5/2018 | Davis | B24B 23/04 |
| 2019/0090405 | A1 * | 3/2019 | Bermudez | A01G 3/062 |
| 2019/0280639 | A1 * | 9/2019 | Trinkle | A01D 34/416 |
| 2022/0266437 | A1 * | 8/2022 | Silorio | A01D 34/90 |

FOREIGN PATENT DOCUMENTS

WO WO-2013122267 A1 * 8/2013 ..... A01D 34/73

* cited by examiner

*Primary Examiner* — Eyamindae C Jallow
(74) *Attorney, Agent, or Firm* — Barry Choobin; Patent 360

(57) ABSTRACT

A multipurpose reciprocating device for scraping, breaking, scouring, or cutting a deposited material, such as snow build-ups. The multipurpose reciprocating device includes a housing configured as a rear handle that is capable of being grabbed in a hand; a reciprocating motor encased within the housing; an elongated shaft that has a proximal end and a distal end, the proximal end is operably coupled to the reciprocating motor, wherein the reciprocating motor is configured to reciprocate the shaft; and an attachment interchangeably coupled to the distal end of the elongated shaft.

6 Claims, 4 Drawing Sheets

100

MULTIFUNCTIONAL RECIPROCATING UTILITY DEVICE

CROSS-REFERENCE TO RELATED APPLICATIONS

This application claims priority from a U.S. Provisional Patent Appl. No. 63/183,993 filed on May 4, 2021, which is incorporated herein by reference in its entirety.

FIELD OF INVENTION

The present invention relates to a multifunctional reciprocating utility device, and more particularly, the present invention relates to a multifunctional reciprocating utility device for cutting, breaking, scraping, and scourging a build-up material.

BACKGROUND

Certain tools are quite common in households for day-to-day fixes and do-it-yourself projects. Examples of such tools include screwdrivers, chisels, hammers, pliers, wrenches, and the like. Similarly, the households with gardens generally have gardening tools including a trowel, weeders, and the like. Households in regions receiving heavy snowfall generally have a scraper to break and remove snow buildups. The tools for households are typically hand-operated, small in size, and manual. Professional power-operated tools are heavy and costly, and not suitable for home use. However, using manual tools can be laborious, time-consuming, and exhausting. For example, a long handle scraper is generally used to break snow buildup. The use of a manual scraper to break the snow buildup can be hard and exhausting. For the elders and people with weak muscular strength, using the scraper can be painful. Professional power-operated machines are available; however, they are costly and complex. Moreover, the available professional machines are bulky to carry. Renting professional machines is also not always feasible depending upon availability. The high cost of renting is also a deterrent.

Thus, a need is appreciated for power utility device for home use or small-scale use that is portable, lightweight, and cost-effective.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a multipurpose utility device that is portable and light in weight.

It is another object of the present invention that the multipurpose utility device is cost-effective.

It is still another object of the present invention that the multipurpose utility device is easy to use.

It is a further object of the present invention that the multipurpose utility device does not require a complex setup.

It is yet another object of the present invention that the multipurpose utility device can be used for a variety of purposes.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
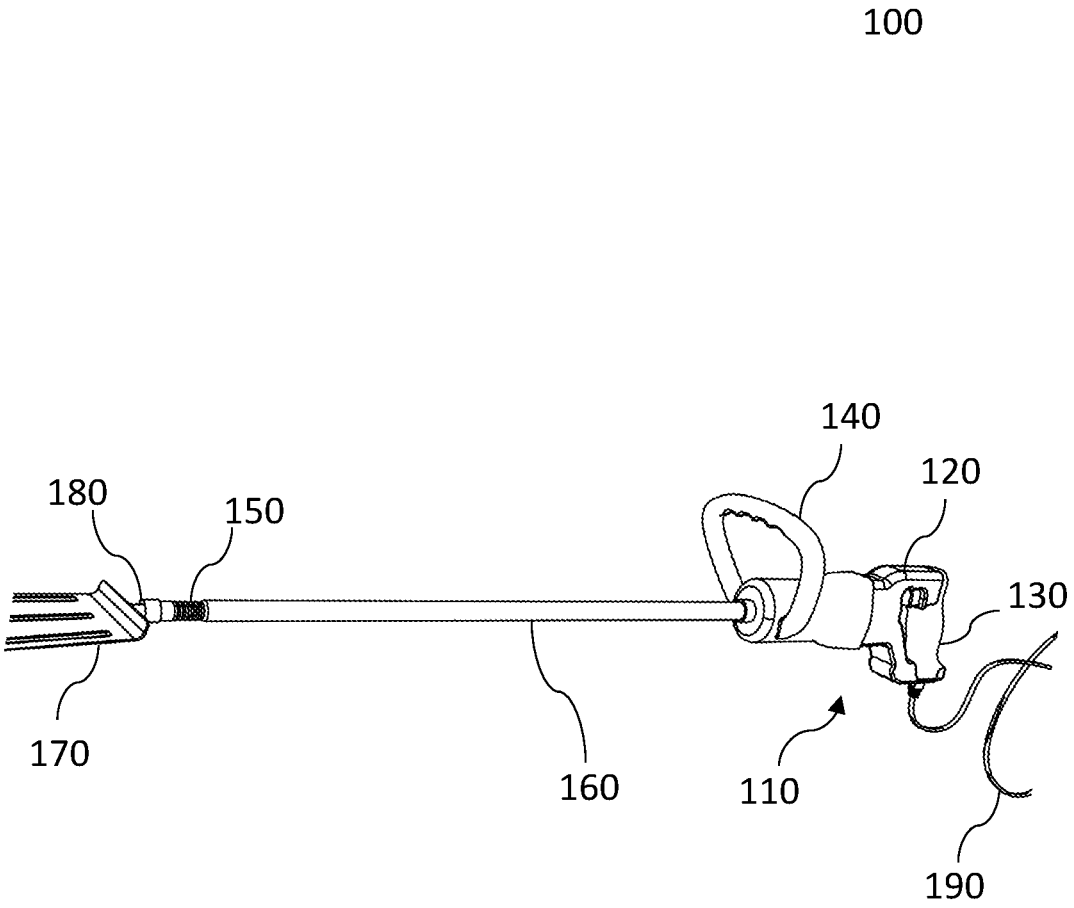
FIG. 1 is a perspective view of the disclosed multipurpose utility device, according to an exemplary embodiment of the present invention.
Figure 2:
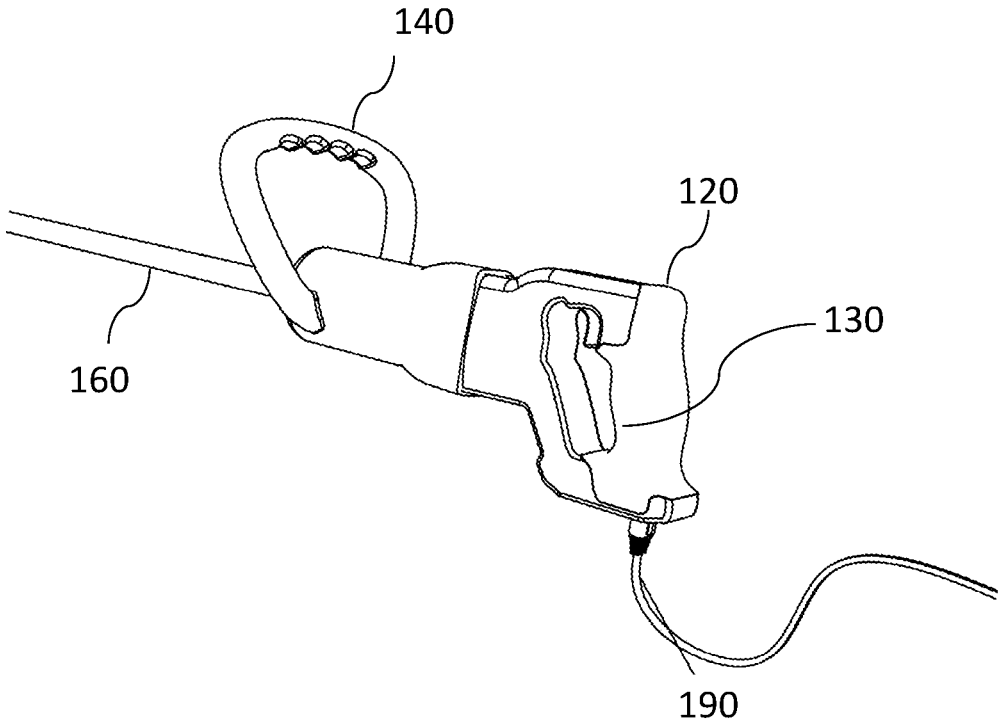
FIG. 2 is an enlarged view of a handle portion of the multipurpose utility device, according to an exemplary embodiment of the present invention.
Figure 3:
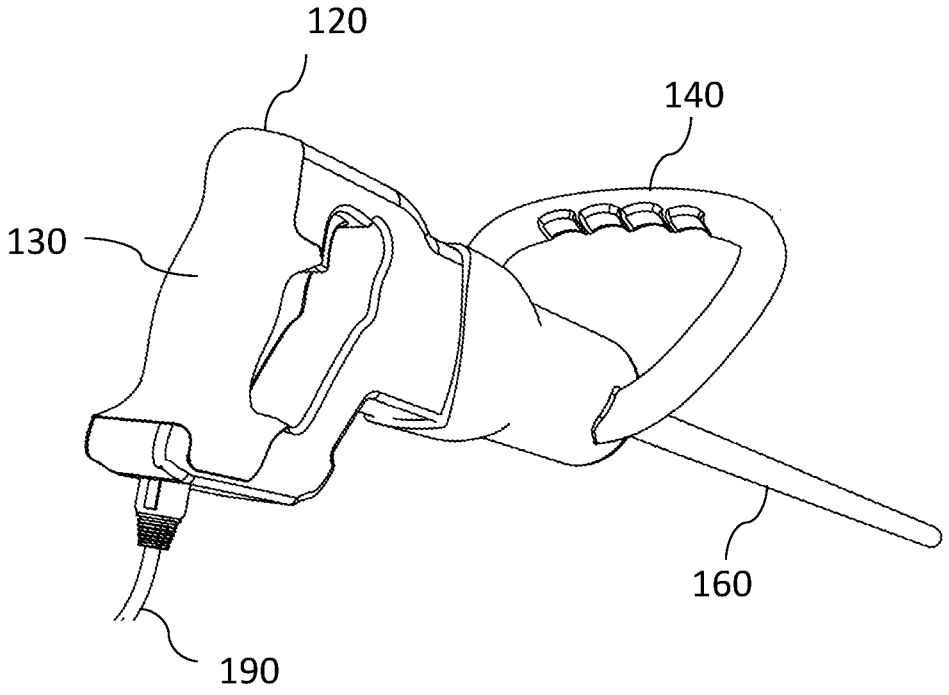
FIG. 3 shows another enlarged view of the handle portion, according to an exemplary embodiment of the present invention.
Figure 4:
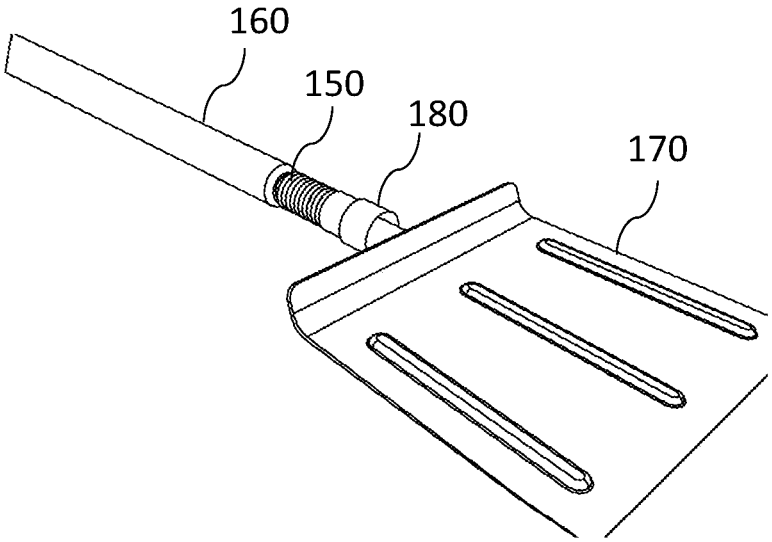
FIG. 4 is an enlarged view of the front of the multipurpose utility device and an attachment of the multipurpose utility device, according to an exemplary embodiment of the present invention.

Subject matter will now be described more fully hereinafter. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as apparatus and methods of use thereof. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

The following detailed description is described with reference to the drawings, wherein like reference numerals are used to refer to like elements throughout. In the following description, for purposes of explanation, specific details may be set forth in order to provide a thorough understanding of the subject innovation. It may be evident, however, that the claimed subject matter may be practiced without these specific details. In other instances, well-known structures and apparatus are shown in block diagram form in order to facilitate describing the subject innovation. Moreover, the drawings may not be to scale.

Disclosed is a multipurpose utility device for households, offices, small businesses, and the like. The disclosed multipurpose utility device can break stubborn masses of material accumulated. For example, the disclosed multipurpose utility device can be used to break snow buildup without applying significant muscular strength. The multipurpose utility device can be used for a variety of purposes such as digging a hole, removing weeds, and the like. Referring to FIG. 1 which shows a perspective view of the disclosed multipurpose utility device 100. The multipurpose utility device includes a handle portion, a shaft, and an attachment. The handle portion includes a reciprocating motor, a battery, control circuitry for the reciprocating motor, and a button. On the rear side of the handle portion 110 can be a rear handle 130 that can be of a gun shape. The motor and battery can be encased in a housing 120. The housing can be molded in the form of a gun shape rear handle. The operator can grasp the rear handle in his hand. The button (not shown) can be provided as a trigger on the front of the rear handle 130, similar to a trigger in a handgun. The user while grabbing the rear handle 130 in his hand can use one of his fingers, preferably the index finger, to actuate the trigger. Such gun shape handle and trigger mechanism are known in several hand tools such as drill machines. A top handle 140 can be provided on top of the handle portion 110. The top handle 140 can be grabbed in another hand. For maneuvering the disclosed multipurpose utility device 100, an operator can grasp the rear handle 130 in his active hand and can grab the top handle with another hand. The reciprocating motor can be a variable speed reciprocating motor, and the trigger provided can be a variable speed trigger, wherein the pressure on the trigger can be increased to increase the speed of the motor and decreased to decrease the speed of the motor.

The motor can be powered by a battery also enclosed within the housing. The battery can be a rechargeable battery, such as a lithium-ion battery. Suitable charging circuitry can also be provided that allows charging the battery. The charging circuitry can also be enclosed within the housing. The disclosed device can also be powered directly by the main power supply, through a wire. Wireless charging and wireless power supply are also within the scope of the present invention.

The multipurpose utility device 100 can further include a shaft 150 coupled to the reciprocating motor. The shaft can be reciprocatively driven by the motor. The shaft 150 can be of an elongated tubular shape and encased within a hollow outer tube 160. The shaft 150 and the hollow outer tube 160 can be made from multiple members wherein the members can be joined to increase the length of the shaft and the hollow outer tube 160. For example, opposite ends of each member can have a thread for fastening the member to another member. The top handle 140 can also be mounted to the hollow outer tube 160, wherein a coupling mechanism can slidably mount the top handle 140 to the hollow outer tube 160. The coupling mechanism can include restricting means that allow fixing the position of the top handle 140 on the hollow outer tube 160. The hollow outer tube 160 can be shorter in length than the shaft 150, wherein the end of the hollow outer tube 160 be coupled to the housing 120.

To the free end of the shaft 150 could be coupled an attachment 170. Examples of the attachment include a functional part of a Garden Shovel/Hole Digger, Chisel, Weeder, Hedge Trimmer, Pruning (Saw), Drywall Sander, Concrete/Vibra Squeegee, Paint Scraper, and the like. The attachments can be interchangeably coupled to the shaft. The attachment and the shaft can have a suitable fastening mechanism 180 to couple the attachment to the shaft. For example, the fastening mechanism can be threaded wherein the attachments and shaft have corresponding threads for engaging the attachment to the shaft. Alternatively, the fastening mechanism can be a snap-fit mechanism or a twist and lock mechanism, or any similar mechanism is within the scope of the present invention.

In use, the user can attach a desired attachment to the shaft. After coupling the attachment, the user can grab the rear handle using one hand and grab the top handle using the other hand. The attachment can be pointed to the target object, and the trigger can be pressed. The reciprocating action of the attachment can break the build-up material, such as the snow build-up without requiring physical strength to break the stubborn material buildup. The portable tool can speed up a multitude of projects with minimal effort. The disclosed device can make the home and garden projects easier on the body—especially the back and arms.

The disclosed multipurpose utility device can be perfect for elderly and/or disabled persons. The disclosed multipurpose utility device can be used by households and businesses. For example, ice in storefronts is required to be removed to prevent someone from slipping and/or falling on entering the premises.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A multipurpose reciprocating device for chiseling and scraping deposited ice on ground, the multipurpose reciprocating device comprises:

a housing configured as a rear handle that is capable of being grabbed in a hand;

a reciprocating motor encased within the housing, the reciprocating motor is a variable speed reciprocating motor;

a shaft that has a proximal end and a distal end, the proximal end is operably coupled to the reciprocating motor, wherein the reciprocating motor is configured to reciprocate the shaft;

an attachment interchangeably coupled to the distal end of the shaft; and a variable speed trigger operably coupled to the reciprocating motor, the variable speed trigger protrudes from the housing, the variable speed trigger is positioned so that when the rear handle is grabbed in the hand, the variable speed trigger is within reach of a finger of the hand, wherein the variable speed trigger is configured to cause an increase to decrease in a speed of the reciprocating motor based on a pressure applied on it by the finger, wherein the multipurpose reciprocating device comprises a hollow outer tube coupled to the housing, wherein the hollow outer tube encases the shaft, and a top handle slidably mounted to the hollow housing, the hollow tube is shorter in length than the shaft.

2. The multipurpose reciprocating device according to claim 1, wherein the attachment is a functional portion of a chisel.

3. The multipurpose reciprocating device according to claim 1, wherein the attachment is a hedge trimmer.

4. A method for chiseling and scraping deposited ice on ground, the method comprises:

providing a multipurpose reciprocating device comprising:

a housing configured as a rear handle that is capable of being grabbed in a hand, a reciprocating motor encased within the housing, the reciprocating motor is a variable speed reciprocating motor, a shaft that has a proximal end and a distal end, the proximal end is operably coupled to the reciprocating motor, wherein the reciprocating motor is configured to reciprocate the shaft, an attachment interchangeably coupled to the distal end of the shaft, a variable speed trigger operably coupled to the reciprocating motor, the variable speed trigger protrudes from the housing, the variable speed trigger is positioned so that when the rear handle is grabbed in the hand, the variable speed trigger is within reach of a finger of the hand, wherein the variable speed trigger is configured to cause an increase to decrease in a speed of the reciprocating motor based on a pressure applied on it by the finger, wherein the multipurpose reciprocating device comprises a hollow outer tube coupled to the housing, wherein the hollow outer tube encases the shaft and a top handle slidably mounted to the hollow housing, the hollow tube is shorter in length than the shaft; and scraping the deposited ice using the multipurpose reciprocating device.

5. The method according to claim 4, wherein the attachment is a functional portion of a chisel.

6. The method according to claim 4, wherein the attachment is a hedge trimmer.

* * * * *